US010191431B2

(12) United States Patent
Kidera

(10) Patent No.: US 10,191,431 B2
(45) Date of Patent: Jan. 29, 2019

(54) IMAGE FORMING SYSTEM

(71) Applicant: Konica Minolta, Inc., Chiyoda-ku, Tokyo (JP)

(72) Inventor: Hiroshige Kidera, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/161,018

(22) Filed: May 20, 2016

(65) Prior Publication Data

US 2016/0378041 A1 Dec. 29, 2016

(30) Foreign Application Priority Data

Jun. 25, 2015 (JP) ..... 2015-127494

(51) Int. Cl.
*G03G 15/00* (2006.01)

(52) U.S. Cl.
CPC ..... *G03G 15/6529* (2013.01); *G03G 2215/00021* (2013.01)

(58) Field of Classification Search
CPC ..... G03G 15/6529
USPC ..... 399/16
See application file for complete search history.

(56) References Cited

U.S. PATENT DOCUMENTS 5,568,246 A * 10/1996 Keller ..... G03G 15/00 271/288
5,598,257 A * 1/1997 Keller ..... B41J 3/60 271/902
6,317,581 B1 * 11/2001 Boehmer ..... G03G 15/00 399/401
7,206,532 B2 * 4/2007 Lofthus ..... G03G 15/5062 399/371
7,305,198 B2 * 12/2007 Julien ..... G03G 15/6585 399/335

(Continued)

FOREIGN PATENT DOCUMENTS

JP A-2001-502813 2/2001
JP A-2005-022243 1/2005

(Continued)

OTHER PUBLICATIONS

The First Office Action dated Jan. 29, 2018, in Chinese Patent Application No. 201610464280.0, 14 pages.

*Primary Examiner* — Anthony Nguyen
(74) *Attorney, Agent, or Firm* — Squire Patton Boggs (US) LLP

(57) ABSTRACT

A series-connected tandem image forming system includes first and second image forming apparatuses capable of forming images on recording media by image forming units, the first and second image forming apparatuses being connected in series, the image forming system forming an image on a recording media by either one or both of the first and second image forming apparatuses, wherein the first image forming apparatus includes a first conveyance path for conveyance of the recording medium, and a second conveyance path for conveyance of the recording medium, the first and second conveyance paths being selectable therebetween, the second image forming apparatus includes a third conveyance path for conveyance of the recording medium, and a fourth conveyance path for conveyance of the recording medium, the third and fourth conveyance paths being selectable therebetween.

14 Claims, 5 Drawing Sheets

(56) References Cited

U.S. PATENT DOCUMENTS

| | | | | |
|---|---|---|---|---|
| 8,570,580 | B2 * | 10/2013 | Tachibana | B41J 3/54 358/1.12 |
| 2006/0268318 | A1 * | 11/2006 | Lofthus | G06F 3/1208 358/1.15 |
| 2007/0002085 | A1 * | 1/2007 | Sampath | G03G 15/55 347/5 |
| 2007/0120305 | A1 * | 5/2007 | Mandel | B65H 19/18 270/1.01 |
| 2008/0253818 | A1 * | 10/2008 | Sasaki | G03G 15/238 399/401 |
| 2010/0264574 | A1 * | 10/2010 | Tyson | B65H 3/44 271/3.14 |
| 2015/0063848 | A1 * | 3/2015 | Ikuta | G03G 15/6564 399/45 |

FOREIGN PATENT DOCUMENTS

| | | |
|---|---|---|
| JP | 2014-071181 A | 4/2014 |
| WO | WO 1998/018052 | 4/1998 |

* cited by examiner

IMAGE FORMING SYSTEM

The entire disclosure of Japanese Patent Application No. 2015-127494 filed on Jun. 25, 2015 including description, claims, drawings, and abstract are incorporated herein by reference in its entirety.

BACKGROUND OF THE INVENTION

Field of the Invention

The present invention relates to an image forming system.

Description of the Related Art

In recent years, series-connected tandem image forming systems in which two image forming apparatuses are connected in series for two-sided printing and the like have been in practical use (refer to JP 2005-022243 A, for example). For example, a primary image forming apparatus (primary apparatus) forms an image on a front face of a sheet, and a secondary image forming apparatus (secondary apparatus) forms an image on a back face thereof. This enables improvement in productivity as compared to a case where two-sided printing is performed by one image forming apparatus. Such series-connected tandem image forming systems are typically applied to the field of production print where higher productivity is sought.

JP 2005-022243 A discloses an image forming system capable of total management through sorting of printed recording media into one-sided printing and two-sided printing without lowering the processing efficiency of one-sided printing and two-sided printing.

Furthermore, JP 2001-502813 W does not disclose a series-connected tandem image forming system but discloses an image forming apparatus including two conveyance paths for conveying sheets, and image forming units disposed on the two conveyance paths and configured to form images on the sheets. With the image forming apparatus disclosed in JP 2001-502813 W, even in a case where a failure occurs in one of the image forming units, an image can be formed on a sheet by the other image forming unit.

The aforementioned series-connected tandem image forming systems, however, are disadvantageous in that the entire image forming system halts and printing is disabled in the event of occurrence of a problem in image formation in either of the two image forming apparatuses, such as a failure of the printed control board for controlling the image forming process, or a paper jam.

JP 2005-022243 A mentioned above teaches a measure for two-sided printing even if a failure occurs in either of the first printer and the second printer, but has another disadvantage in that two sheet discharging devices (first sheet discharging device and a second sheet discharging device) are required for this measure, which results in an increase in size of the image forming system.

Furthermore, the technology disclosed by JP 2001-502813 W mentioned above relates to one image forming apparatus and cannot solve the disadvantages relating to the series-connected tandem image forming system.

SUMMARY OF THE INVENTION

An object of the present invention is to provide a series-connected tandem image forming system capable of performing printing even when a problem in image formation occurs in either of the two image forming apparatuses.

To achieve the abovementioned object, according to an aspect, a series-connected tandem image forming system reflecting one aspect of the present invention comprises first and second image forming apparatuses capable of forming images on recording media by image forming units, the first and second image forming apparatuses being connected in series, the image forming system forming an image on a recording media by either one or both of the first and second image forming apparatuses, wherein the first image forming apparatus includes a first conveyance path for conveyance of the recording medium, the first conveyance path being provided with an image forming unit, and a second conveyance path for conveyance of the recording medium, the second conveyance path being provided with no image forming unit, the first and second conveyance paths being selectable therebetween, the second image forming apparatus includes a third conveyance path for conveyance of the recording medium, the third conveyance path being provided with an image forming unit, and a fourth conveyance path for conveyance of the recording medium, the fourth conveyance path being provided with no image forming unit, the third and fourth conveyance paths being selectable therebetween.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the drawings. However, the scope of the invention is not limited to the illustrated examples. Although a recording medium on which an image is formed in the image forming system is paper in the description of the present embodiment, the present invention is not limited thereto. The recording medium may be tacky paper (self-adhesive paper), for example, instead of paper.

[Overall Configuration of Image Forming System 10]

Figure 1:
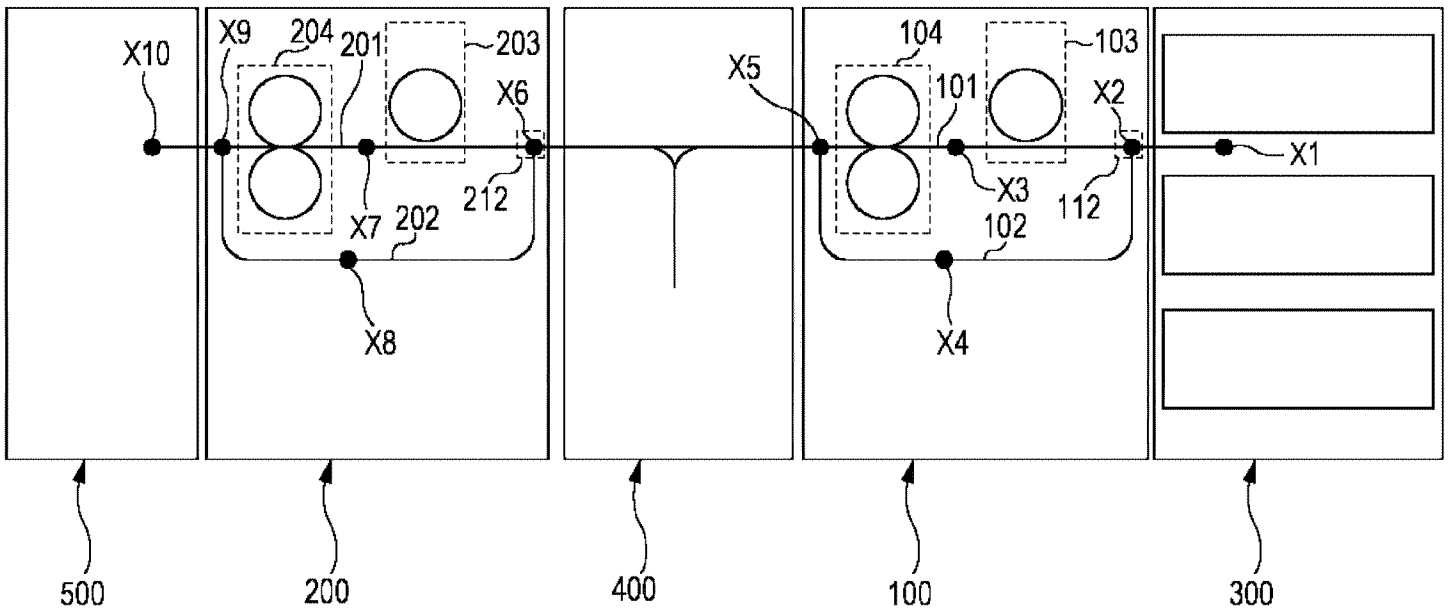
FIG. 1 is a diagram illustrating an overall configuration of an image forming system according to an embodiment.
Figure 2:
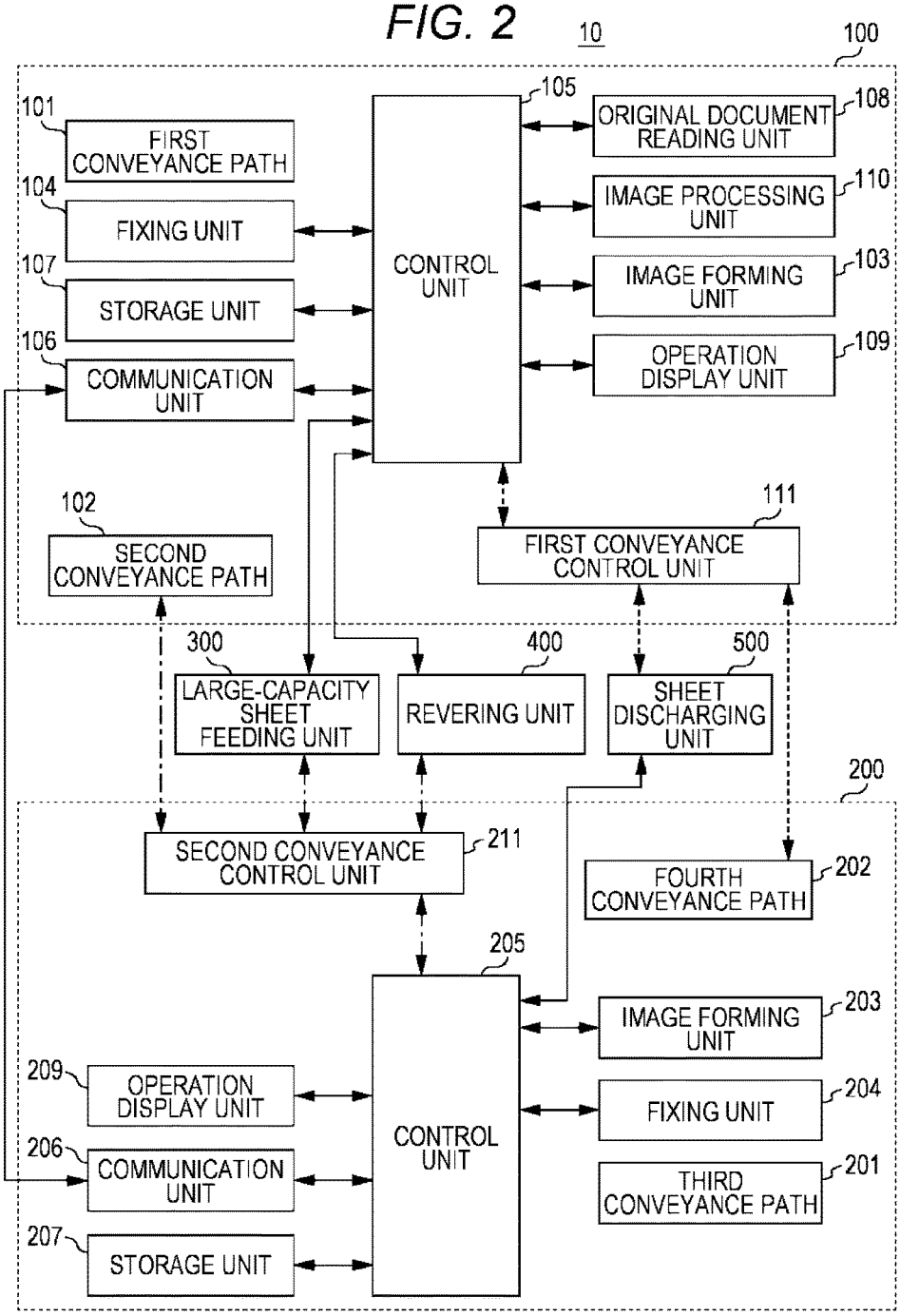
FIG. 2 is a diagram illustrating control blocks of the image forming system according to the embodiment.

FIG. 1 is a diagram illustrating an overall configuration of an image forming system 10 according to the embodiment. FIG. 2 is a diagram illustrating control blocks of the image forming system 10 according to the embodiment. As illustrated in FIG. 1, the image forming system 10 includes a large-capacity sheet feeding unit 300, a first image forming apparatus 100, a reversing unit 400, a second image forming apparatus 200, and a sheet discharging unit 500, which are connected in this order. A line connecting points X1, X2, X3, X5, X6, X7, X9, and X10 in FIG. 1 represents a sheet conveyance path. A system including two or more image forming apparatuses connected in series like the image forming system 10 illustrated in FIG. 1 is commonly called a series-connected tandem image forming system.

For two-sided printing, the image forming system 10 feeds a sheet from the large-capacity sheet feeding unit 300 and performs printing on a front face of the sheet by the first image forming apparatus 100. Thereafter, the image forming system 10 reverses the sheet by the reversing unit 400 and conveys the sheet to the second image forming apparatus 200. The image forming system 10 then performs printing on a back face of the sheet by the second image forming apparatus 200. After the printing on the back face of the sheet, the image forming system 10 discharges the sheet to the sheet discharging unit 500.

For one-sided printing, the image forming system 10 feeds a sheet from the large-capacity sheet feeding unit 300, performs one-sided printing by the first image forming apparatus 100, and only conveys the sheet by the second image forming apparatus 200. Alternatively, the image forming system 10 feeds a sheet from the large-capacity sheet feeding unit 300, only conveys the sheet without performing printing by the first image forming apparatus 100, and performs one-sided printing by the second image forming apparatus 200. A sequence of procedures of a printing process will be described in detail as a representative example of the former case. First, the image forming system 10 feeds a sheet from the large-capacity sheet feeding unit 300 and performs printing on a front face of the sheet by the first image forming apparatus 100. Thereafter, the image forming system 10 conveys the sheet to the second image forming apparatus 200. The image forming system 10 then passes, by the second image forming apparatus 200, the sheet resulting from the one-sided printing. Finally, the image forming system 10 discharges the sheet resulting from the one-sided printing to the sheet discharging unit 500.

Next, a configuration of the functions of the image forming system 10 will be described.

The large-capacity sheet feeding unit 300 includes sheet feed trays each for storing one of different kinds of paper, and feeds a sheet stored in the sheet feed trays to the first image forming apparatus 100 (point X1→point X2). The sheet feeding operation of the large-capacity sheet feeding unit 300 is controlled by a control unit 105 included in the first image forming apparatus 100.

The first image forming apparatus 100 forms an image on one face of the sheet fed from the large-capacity sheet feeding unit 300. As illustrated in FIGS. 1 and 2, the first image forming apparatus 100 includes a first conveyance path 101, a second conveyance path 102, an image forming unit 103, a fixing unit 104, the control unit 105, a communication unit 106, a storage unit 107, an original document reading unit 108, an operation display unit 109 (corresponding to a "second informing unit" in the present invention), an image processing unit 110, a first conveyance control unit 111, and a switching gate 112.

The control unit 105 includes a central processing unit (CPU), a read only memory (ROM), a random access memory (RAM), and the like. The CPU reads a program associated with processing from the ROM, expands the program in the RAM, and performs centralized control on operations of the respective blocks in the first image forming apparatus 100 in cooperation with the expanded program. In this process, various data stored in the storage unit 107 are referred to. The storage unit 107 is constituted by a non-volatile semiconductor memory (so-called flash memory) or a hard disk drive, for example.

The control unit 105 transmits and receives various data to and from external devices (personal computers, for example) connected to a communication network such as a local area network (LAN) or a wide area network (WAN) via the communication unit 106. The control unit 105 receives image data transmitted from an external device and outputs the image data (input image data) to the image forming unit 103, for example. The communication unit 106 is constituted by a communication control card such as a LAN card.

The control unit 105 transmits and receives various data to and from the second image forming apparatus 200 via the communication unit 106. The control unit 105 also controls operations of the second image forming apparatus 200 in cooperation with a control unit 205 of the second image forming apparatus 200 via the communication unit 106.

The original document reading unit 108 optically scans an original document conveyed onto a contact glass, and focuses reflected light from the original document onto a light receiving surface of a CCD (charge coupled device) sensor to read the original document. The conveyance of the original document onto the contact glass is conducted by an automatic document feeder (ADF). Alternatively, the original document may be placed manually on the contact glass.

The operation display unit 109 has a touch panel screen. A user can perform input operations for various instructions and settings such as printing conditions (one-sided/two-sided printing, the density and magnification of the image, the number of copies, and paper size and weight, for example) by using the touch panel screen.

The image processing unit 110 includes a circuit for analog-to-digital (A/D) conversion and a circuit for digital image processing. The image processing unit 110 performs A/D conversion to generate digital image data from an analog image signal obtained by the CCD sensor of the original document reading unit 108, and outputs the digital image data to the image forming unit 103.

The image forming unit 103 and the fixing unit 104, which will be described below, are provided on the first conveyance path 101.

The image forming unit 103 emits laser light based on the digital image data generated by the image processing unit 110 or the digital image data obtained by the control unit 105, and irradiate a photosensitive drum with the emitted laser light to form an electrostatic latent image on the photosensitive drum (exposure step).

The image forming unit 103 has a configuration for performing, in addition to the exposure step, a charging step to be performed before the exposure step, a developing step to be performed after the exposure step, a transfer step subsequent to the developing step, and a cleaning step subsequent to the transfer step In the charging step, the image forming unit 103 uniformly charges the surface of the photosensitive drum by corona discharge from a charger. In the developing step, the image forming unit 103 causes toner contained in a developer in a developing device to adhere to the electrostatic latent image on the photosensitive drum to form a toner image on the photosensitive drum.

In the transfer step, the image forming unit 103 transfers the toner image on the photosensitive drum onto a sheet conveyed along the first conveyance path 101. In the cleaning step, the image forming unit 103 removes toner remaining on the photosensitive drum after the transfer step.

The fixing unit 104 applies heat and pressure to the toner image on the sheet delivered into the fixing nip portion (thermal fixing) to fix the toner image onto the sheet (fixing step). Consequently, a fixed toner image is formed on the sheet.

The first conveyance path 101 is provided with a guide plate for guiding a sheet in a sheet conveyance direction, a plurality of pairs of conveyance rollers configured to rotate under the control of the control unit 105, and the like. The control unit 105 performs control for conveying a sheet fed from the large-capacity sheet feeding unit 300 to the reversing unit 400 through the points X2, X3, and X5 while forming an image on one face (front face) of the sheet.

In the embodiment, when a service call occurs in the first image forming apparatus 100, the control unit 105 detects the service call and causes the operation display unit 109 to display the content of the service call. A service call refers to calling a serviceperson for maintenance because of occurrence of an abnormality in the first image forming apparatus 100, such as a failure of a printed control board (not illustrated) for controlling the image forming process in the first image forming apparatus 100. A paper jam or a service call occurring in the first image forming apparatus 100 is also detected by the control unit 205 of the second image forming apparatus 200 via the communication unit 106.

Furthermore, when a paper jam occurs in the first image forming apparatus 100, the control unit 105 detects the paper jam and causes the operation display unit 109 to display the detail of the paper jam. Specifically, a jam detecting unit (not illustrated) included in the first image forming apparatus 100 senses passage of a sheet through each unit along the first conveyance path 101 by an optical sensor disposed on each unit, and detects occurrence of a paper jam when the time taken for passing between the units becomes a predetermined time or longer. The jam detecting unit then outputs a jam code associated with the detected paper jam to the control unit 105. A jam code is a jam identification number for uniquely identifying the status (such as the position, the cause, and the date and time) of a paper jam. The control unit 105 refers to the jam code output from the jam detecting unit to know a concrete status of the paper jam. Note that the jam detecting unit is not limited to optical sensors but may alternatively be constituted by other mechanisms such as mechanical switches or the like.

The control unit 105 stores service call information indicating the content of a service call occurring in the first image forming apparatus 100 and paper jam information indicating the detail of a paper jam occurring in the first image forming apparatus 100 into the storage unit 107.

The second conveyance path 102, the first conveyance control unit 111, and the switching gate 112 will be described later.

The reversing unit 400 is provided between the first image forming apparatus 100 and the second image forming apparatus 200. For performing two-sided printing in the image forming system 10, the reversing unit 400 reverses a sheet on which image is formed on one face thereof by the first image forming apparatus 100, and conveys the reversed sheet to the second image forming apparatus 200. The reversing operation of the reversing unit 400 is controlled by the control unit 105 of the first image forming apparatus 100.

The second image forming apparatus 200 forms an image on one face of the sheet conveyed from the reversing unit 400. As illustrated in FIGS. 1 and 2, the second image forming apparatus 200 includes a third conveyance path 201, a fourth conveyance path 202, an image forming unit 203, a fixing unit 204, the control unit 205, a communication unit 206, a storage unit 207, an operation display unit 209 (corresponding to a "first informing unit" in the present invention), a second conveyance control unit 211, and a switching gate 212. Since the processing in the image forming unit 203, the fixing unit 204, the control unit 205, the communication unit 206, the storage unit 207, and the operation display unit 209 of the second image forming apparatus 200 is the same as the processing in the image forming unit 103, the fixing unit 104, the control unit 105, the communication unit 106, the storage unit 107, and the operation display unit 109 described with regard to the first image forming apparatus 100, the description thereof will not be repeated here.

The third conveyance path 201 is provided with a guide plate for guiding a sheet in a sheet conveyance direction, a plurality of pairs of conveyance rollers configured to rotate under the control of the control unit 205, and the like. The control unit 205 performs control for conveying a sheet conveyed from the reversing unit 400 to the sheet discharging unit 500 through the points X6, X7, and X9 while forming an image on one face (back face) of the sheet. The image forming unit 203 and the fixing unit 204 are provided on the third conveyance path 201.

The fourth conveyance path 202, the second conveyance control unit 211, and the switching gate 212 will be described later.

The sheet discharging unit 500 includes a discharge tray to which a sheet conveyed from the second image forming apparatus 200 is discharged. The sheet discharging unit 500 stacks sheets having images formed on both faces thereof by the first image forming apparatus 100 and the second image forming apparatus 200 and being conveyed from the second image forming apparatus 200 onto the discharge tray. The sheet discharging operation of the sheet discharging unit 500 is controlled by the control unit 205 of the second image forming apparatus 200.

With the configuration described above, the image forming system 10 forms an image on a front face of a sheet by the primary first image forming apparatus 100 and forms an image on a back face of the sheet by the secondary second image forming apparatus 200, which improves the productivity as compared to a chase where two-sided printing is performed by one image forming apparatus. There has been a disadvantage, however, in that two-sided printing cannot be performed in the event of occurrence of a problem in image formation in either of the two image forming apparatuses 100 and 200, such as a failure of the printed control board for controlling the image forming process in the image forming apparatus or a paper jam. Thus, in the embodiment, the image forming system 10 has a configuration capable of performing two-sided printing even when a problem in image formation occurs in either of the first image forming apparatus 100 and the second image forming apparatus 200.

Specifically, as described above, the first image forming apparatus 100 and the second image forming apparatus 200 have the second conveyance path 102 and the fourth conveyance path 202, respectively. The first image forming apparatus 100 and the second image forming apparatus 200 also have the first conveyance control unit 111 configured to perform first conveyance control for conveying a sheet supplied from the first image forming apparatus 100 to the second image forming apparatus 200 through the fourth conveyance path 202 and the second conveyance control unit 211 configured to perform second conveyance control for conveying a sheet through the second conveyance path 102.

The second conveyance path 102 is provided with a guide plate for guiding a sheet in a sheet conveyance direction, a plurality of pairs of conveyance rollers, which can be rotated, and the like. When a problem in image formation occurs in the first image forming apparatus 100, the second conveyance control unit 211 of the second image forming apparatus 200 rotates the pairs of conveyance rollers provided on the second conveyance path 102 to perform the second conveyance control for conveying a sheet fed from the large-capacity sheet feeding unit 300 to the reversing unit 400 through the points X2, X4, and X5 without forming an image thereon. In other words, the second conveyance path 102 is a bypass path for a sheet to bypass the image forming unit 103 and the fixing unit 104 when a problem in image formation occurs in the first image forming apparatus 100.

When printing is not to be performed on a sheet in the second image forming apparatus 200 and two-sided printing is to be performed on the sheet in the first image forming apparatus 100, the second conveyance path 102 is also used as a two-side conveyance path for reversing the sheet while the sheet passes through the points X5, X4, and X2 after image formation on one face (front face) is performed while the sheet passes through the points X2, X3, and X5, and for delivering the sheet onto the first conveyance path 101 for performing image formation on the other face (back face).

The switching gate 112 for switching the conveyance path for conveying a sheet in the first image forming apparatus 100 between the first conveyance path 101 and the second conveyance path 102 is provided near the point X2. The conveyance path switching operation of the switching gate 112 is controlled by the second conveyance control unit 211 of the second image forming apparatus 200.

Figure 3A:
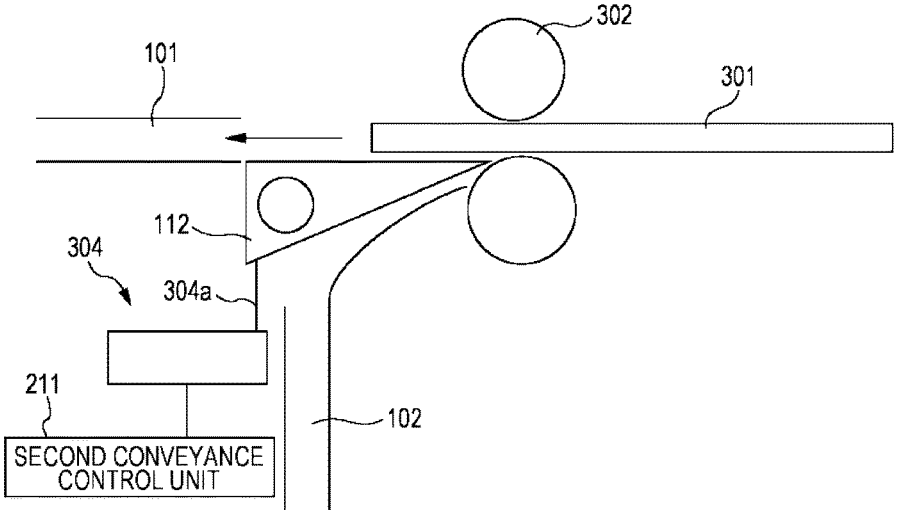
FIGS. 3A and 3B are diagrams explaining a specific configuration and operation of a switching gate.
Figure 3B:
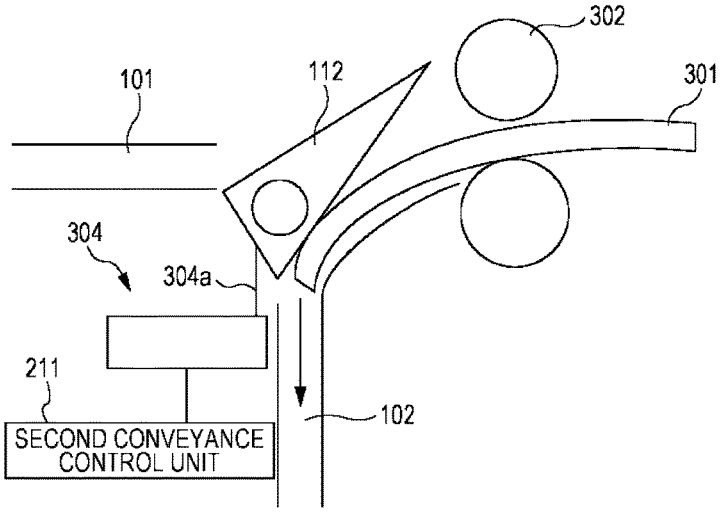

Next, a specific configuration and operation of the switching gate 112 will be described with reference to FIGS. 3A and 3B. FIG. 3A illustrates a state in which a sheet 301 fed from the large-capacity sheet feeding unit 300 is conveyed to the first conveyance path 101 by the rotation of conveyance rollers 302. FIG. 3B illustrates a state in which a sheet 301 fed from the large-capacity sheet feeding unit 300 is conveyed to the second conveyance path 102 by the rotation of conveyance rollers 302.

The switching gate 112 is configured to be turn in response to a movement of a movable member 304*a* of a solenoid 304 to switch the conveyance direction of the sheet 301 fed from the large-capacity sheet feeding unit 300. The solenoid 304 is a mechanical component configured to receive a request signal requesting to switch the conveyance path from the second conveyance control unit 211 and move the movable member 304*a* linearly. To be more specific, the solenoid 304 includes a solenoid main unit and the movable member 304*a*. When the solenoid 304 is to retract the movable member 304*a* in to the solenoid main unit, that is, when the movable member 304*a* is to be moved downward in FIGS. 3A and 3B, the switching gate 112 turns in the clockwise direction in FIGS. 3A and 3B. When the solenoid 304 is to cause the movable member 304*a* to protrude from the solenoid main unit, that is, when the movable member 304*a* is to be moved upward in FIGS. 3A and 3B, the switching gate 112 turns in the counterclockwise direction in FIGS. 3A and 3B.

When a problem in image formation occurs in the first image forming apparatus 100, the second conveyance control unit 211 outputs a request signal requesting to switch the conveyance direction of the sheet 301 from the first conveyance path 101 to the second conveyance path 102 to the solenoid 304. The solenoid 304 in receipt of the request signal turns the switching gate 112 as shown in FIG. 3B to switch the conveyance direction of the sheet 301 from the first conveyance path 101 to the second conveyance path 102. The second conveyance control unit 211 then rotates the pairs of conveyance rollers on the second conveyance path 102 to perform the second conveyance control for conveying the sheet 301 by using the second conveyance path 102.

When a problem in image formation occurs in the first image forming apparatus 100, the second conveyance control unit 211 also controls the sheet feeding operation of the large-capacity sheet feeding unit 300 and the reversing operation of the reversing unit 400 in place of the control unit 105 before the occurrence of the problem.

The fourth conveyance path 202 is provided with a guide plate for guiding a sheet in a sheet conveyance direction, a plurality of pairs of conveyance rollers, which can be rotated, and the like. When a problem in image formation occurs in the second image forming apparatus 200, the first conveyance control unit 111 of the first image forming apparatus 100 rotates the pairs of conveyance rollers provided on the fourth conveyance path 202 to perform the first conveyance control for conveying a sheet conveyed from the reversing unit 400 to the sheet discharging unit 500 through the points X6, X8, and X9 without forming an image thereon. In other words, the fourth conveyance path 202 is a bypass path for a sheet to bypass the image forming unit 203 and the fixing unit 204 when a problem in image formation occurs in the second image forming apparatus 200.

When printing is not to be performed on a sheet in the first image forming apparatus 100 and two-sided printing is to be performed on the sheet in the second image forming apparatus 200, the fourth conveyance path 202 is also used as a two-side conveyance path for reversing the sheet while the sheet passes through the points X9, X8, and X6 after image formation on one face (front face) is performed while the sheet passes through the points X6, X7, and X9, and for delivering the sheet onto the third conveyance path 201 for performing image formation on the other face (back face).

The switching gate 212 for switching the conveyance path for conveying a sheet in the second image forming apparatus 200 between the third conveyance path 201 and the fourth conveyance path 202 is provided near the point X6. The conveyance path switching operation of the switching gate 212 is controlled by the first conveyance control unit 111 of the first image forming apparatus 100.

Since a specific configuration of the switching gate 212 is similar to that of the switching gate 112 described with reference to FIGS. 3A and 3B, the description thereof will not be repeated.

When a problem in image formation occurs in the second image forming apparatus 200, the first conveyance control unit 111 outputs a request signal requesting to switch the conveyance direction from the third conveyance path 201 to the fourth conveyance path 202 to the solenoid capable of turning the switching gate 212. The solenoid in receipt of the request signal turns the switching gate 212 to switch the sheet conveyance direction from the third conveyance path 201 to the fourth conveyance path 202. The first conveyance control unit 111 then rotates the pairs of conveyance rollers on the fourth conveyance path 202 to perform the first conveyance control for conveying the sheet by using the fourth conveyance path 202.

When a problem in image formation occurs in the second image forming apparatus 200, the first conveyance control unit 111 also controls the sheet discharging operation of the sheet discharging unit 500 in place of the control unit 205 before the occurrence of the problem.

Next, operations of the image forming system 10 in a case where a problem in image formation occurs in either of the first image forming apparatus 100 and the second image forming apparatus 200 will be described with reference to an example in which a service call, that is, a problem in image formation occurs in the second image forming apparatus 200.

In this case, since image formation on one face cannot be performed in the second image forming apparatus 200, the image forming system 10 cannot perform such two-sided printing in which an image is formed on one face by each of the image forming apparatus 100 and the image forming apparatus 200.

In this case, in the embodiment, the first image forming apparatus 100 thus performs two-sided printing on a sheet conveyed from the large-capacity sheet feeding unit 300. The sheet on which two-sided printing is performed passes through the reversing unit 400 without being reversed and is conveyed to the second image forming apparatus 200. The first conveyance control unit 111 of the first image forming apparatus 100 then performs a sheet conveyance process of controlling the switching gate 212 to switch the sheet conveyance path in the second image forming apparatus 200 from the third conveyance path 201 to the fourth conveyance path 202 so that the sheet is delivered through the bypass from the point X6 through the point X8 to the point X9 in FIG. 1.

Figure 4:
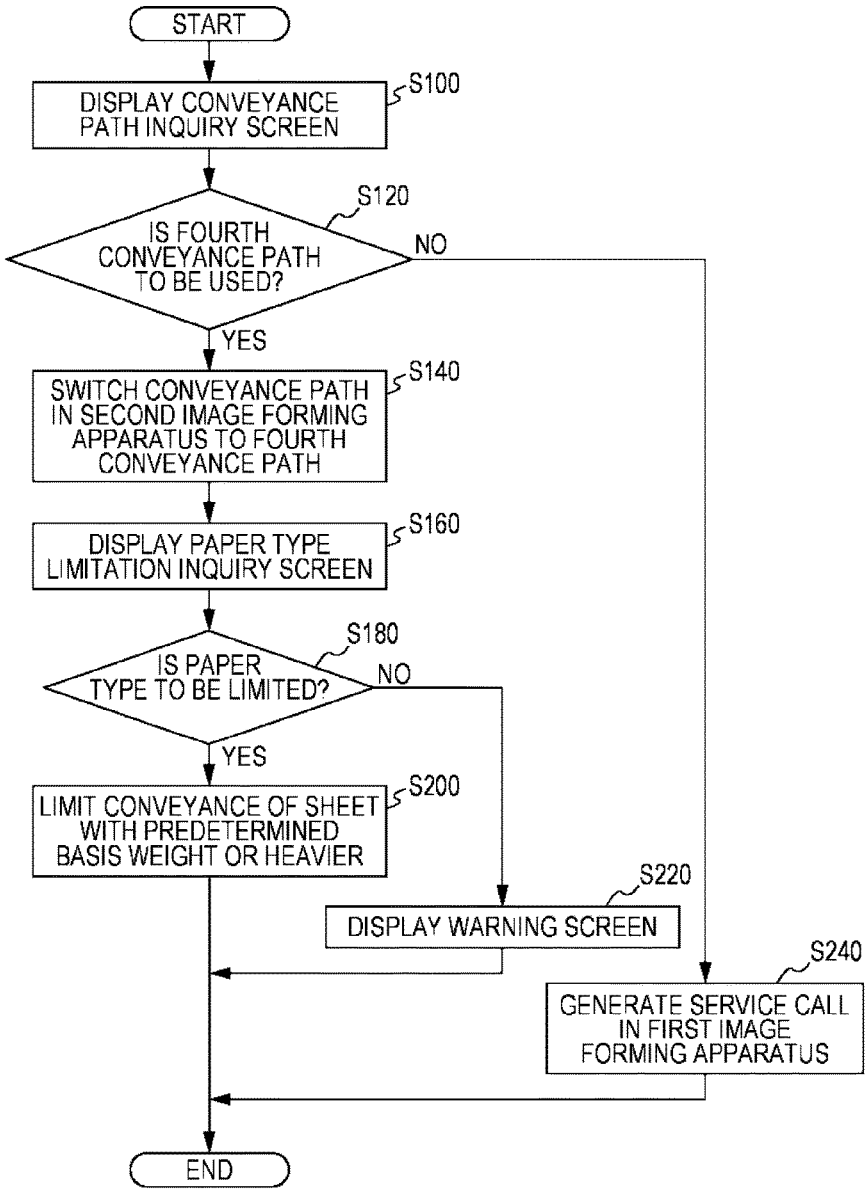
FIG. 4 is a flowchart showing a sheet conveyance control process in the event of a failure of a control unit in a second image forming apparatus, which causes a service call.

Specifically, the sheet conveyance process in a case where a service call occurs in the second image forming apparatus 200 will be explained. FIG. 4 is a flowchart showing the sheet conveyance process in a case where a service call occurs in the second image forming apparatus 200.

The control unit 105 of the first image forming apparatus 100 causes the operation display unit 109 to display a conveyance path inquiry screen for informing the user that the fourth conveyance path 202 is available and inquiring the user whether or not to use the fourth conveyance path 202 to convey a sheet (S100).

Subsequently, the control unit 105 determines whether or not an instruction to convey a sheet by using the fourth conveyance path 202 is received from the user via the operation display unit 109 (S120). If it is determined that the instruction to convey a sheet by using the fourth conveyance path 202 is not received (S120: NO), the control unit 105 generates a service call similar to that occurred in the second image forming apparatus 200 in the first image forming apparatus 100 (S240). Thereafter, the flowchart shown in FIG. 4 is terminated.

If the instruction to convey a sheet by using the fourth conveyance path 202 is received (S120: YES), the control unit 105 outputs, to the first conveyance control unit 111, a request signal requesting to switch the conveyance path from the third conveyance path 201 to the fourth conveyance path 202. The first conveyance control unit 111 receives the request signal output from the control unit 105, and performs control to switch the switching gate 212 to switch the conveyance path in the second image forming apparatus 200 from the third conveyance path 201 to the fourth conveyance path 202 (S140).

Specifically, the first conveyance control unit 111 receives the request signal output from the control unit 105, turns the switching gate 212 so as to deliver a sheet from the point X6 toward the fourth conveyance path 202. The first conveyance control unit 111 then rotates the pairs of conveyance rollers provided on the fourth conveyance path 202 to perform the first conveyance control for conveying the sheet by using the fourth conveyance path 202. The first conveyance control unit 111 also controls the sheet discharging operation of the sheet discharging unit 500 in place of the control unit 205. Note that, when a sheet is to be conveyed through the fourth conveyance path 202, two-sided printing is performed on the sheet in the first image forming apparatus 100. The first conveyance control unit 111 thus performs control to convey the sheet to the second image forming apparatus 200 without reversing the sheet in the reversing unit 400.

Subsequently, the control unit 105 causes the operation display unit 109 to display a paper type limitation inquiry screen for inquiring whether or not to limit the paper type (S160). Subsequently, the control unit 105 determines whether or not an instruction to limit the paper type is received from the user via the operation display unit 109 (S180). If it is determined that the instruction to limit the paper type is received (S180: YES), the control unit 105 performs control not to convey a sheet having a weight of predetermined basis weight (217 [g/m$^2$], for example) or higher to the fourth conveyance path 202 (S200). This is because conveyance of a sheet (a cardboard, in particular) in the sheet conveyance direction different from that in two-sided printing on the fourth conveyance path 202, that is, the two-side conveyance path may cause a conveyance failure (a paper jam, for example). If the image forming system 10 receives a print job of printing on a sheet having a weight of the predetermined basis weight or higher, for example, the control unit 105 performs control to prohibit the sheet feeding operation of feeding the sheet from the large-capacity sheet feeding unit 300. Thereafter, the flowchart shown in FIG. 4 is terminated.

If no instruction to limit the paper type is received (S180: NO), the control unit 105 causes the operation display unit 109 to display a warning screen indicating that a conveyance failure may occur while the sheet is conveyed on the fourth conveyance path 202 (S220). Thereafter, the flowchart shown in FIG. 4 is terminated.

Alternatively, in the flowchart, the conveyance path in the second image forming apparatus 200 may be automatically switched from the third conveyance path 201 to the fourth conveyance path 202 without the display of the conveyance path inquiry screen. Whether or not to display a conveyance path inquiry screen may be preset in the image forming system 10.

Although the case in which a service call occurs in the second image forming apparatus 200 has been explained in the flowchart, a similar sheet conveyance process is performed when a paper jam occurs in the second image forming apparatus 200. In this case, the control unit 105 may determine whether or not to cause the operation display unit 109 to display the conveyance path inquiry screen on the basis of the statuses of past occurrences of paper jams. For example, if paper jams with similar statuses (such as the same position) to that of the paper jam occurring in the second image forming apparatus 200 have occurred a plurality of times in the past, the control unit 105 may display the conveyance path inquiry screen.

A case where paper jams at the same position as that of the paper jam occurring in the second image forming apparatus 200 have occurred a plurality of times in the past is a case where a similar paper jam is likely to occur at the same position in performing image formation again in the second image forming apparatus 200 and the image forming system 10 is likely to halt again. A case where paper jams at the same position as that of the paper jam occurring in the second image forming apparatus 200 have not occurred a plurality of times in the past is a case where the level of the paper jam is low and the image forming system 10 is less likely to halt again in performing image formation again in the second image forming apparatus 200. The control unit 105 determines whether or not to cause the operation display unit 109 to display the conveyance path inquiry screen on the basis of the statuses of past occurrences of paper jams, which reduces the frequency of switching the conveyance path when the level of the paper jam is low, and avoids lowering of the productivity of the image forming system 10.

Furthermore, in the flowchart, control may be performed not to convey a sheet with a weight of the predetermined basis weight or higher to the fourth conveyance path 202 without displaying the paper type limitation inquiry screen after switching the conveyance path in the second image forming apparatus 200 from the third conveyance path 201 to the fourth conveyance path 202. Whether or not to display a paper type inquiry screen may be preset in the image forming system 10.

Next, a case where a service call, that is, a problem in image formation occurs in the first image forming apparatus 100 will be explained.

In this case, since image formation on one face cannot be performed in the first image forming apparatus 100, the image forming system 10 cannot perform such two-sided printing in which an image is formed on one face by each of the image forming apparatus 100 and the image forming apparatus 200.

Thus, in the embodiment, the second conveyance control unit 211 of the second image forming apparatus 200 performs a sheet conveyance process of controlling the switching gate 112 to switch the sheet conveyance path in the first image forming apparatus 100 from the first conveyance path 101 to the second conveyance path 102 so that the sheet is delivered through the bypass from the point X2 through the point X4 to the point X5 in FIG. 1. Thereafter, the second image forming apparatus 200 performs two-sided printing on a sheet conveyed from the first image forming apparatus 100 without being subjected to image formation.

Since the specific sheet conveyance process in the case where a service call occurs in the first image forming apparatus 100 is similar to that in the case where a service call occurs in the second image forming apparatus 200 explained with reference to FIG. 4, the explanation will not be repeated.

While, however, the first conveyance control unit 111 controls the sheet discharging operation of the sheet discharging unit 500 in place of the control unit 205 in the explanation of FIG. 4, the control unit 205 controls the sheet discharging operation of the sheet discharging unit 500 in the case where a service call occurs in the first image forming apparatus 100. In the case where a service call occurs in the first image forming apparatus 100, the second conveyance control unit 211 controls the sheet feeding operation of the large-capacity sheet feeding unit 300 and the reversing operation of the reversing unit 400 in place of the control unit 105.

As described in detail above, the image forming system 10 of the embodiment is a series-connected tandem image forming system in which the first and second image forming apparatuses 100 and 200 capable of forming images on recording media by the image forming units 103 and 203, respectively, are connected in series, and the image forming system 10 forms images on the recording media by using one or both of the first and second image forming apparatuses. The first image forming apparatus 100 includes the first conveyance path 101 for conveyance of the recording media, on which the image forming unit 103 is disposed, and the second conveyance path 102 for conveyance of the recording media, on which no image forming unit is disposed, which can be selected therebetween. The second image forming apparatus 200 includes the third conveyance path 201 for conveyance of the recording media, on which the image forming unit 203 is disposed, and the fourth conveyance path 202 for conveyance of the recording media, on which no image forming unit is disposed, which can be selected therebetween.

According to the embodiment having such a configuration, even when a problem in image formation occurs in either of the two image forming apparatuses (the first and second image forming apparatuses 100 and 200), a recording medium is conveyed through a bypass path (the second conveyance path 102 or the fourth conveyance path 202) in the image forming apparatus in which the problem has occurred and an image forming process (one sided printing/two-sided printing) is performed by the image forming apparatus in which the problem has not occurred, so that a halt of the entire image forming system 10 can be prevented and printing can be performed.

Furthermore, in the embodiment, the two-side conveyance paths provided in advance in the first and second image forming apparatuses 100 and 200 are used as bypass paths, which eliminates the need for additionally providing a conveyance path other than the two-side conveyance path as a bypass path, and prevents the first and second image forming apparatuses 100 and 200 from increasing in size.

Although a case where a problem in image formation occurs owing to occurrence of a service call or a paper jam in either one of the first and second image forming apparatuses 100 and 200 of the image forming system 10 has been described in the embodiment, the present invention is not limited thereto. For example, the case where a problem in image formation occurs in either of the first and second image forming apparatuses 100 and 200 may include a case where an image defect such as color unevenness occurs as a result of an image forming process in the image forming apparatus. Here, operations in a case where a user finds occurrence of an image defect and the conveyance path is to be switched in accordance with the user's instruction will be explained.

Figure 5:
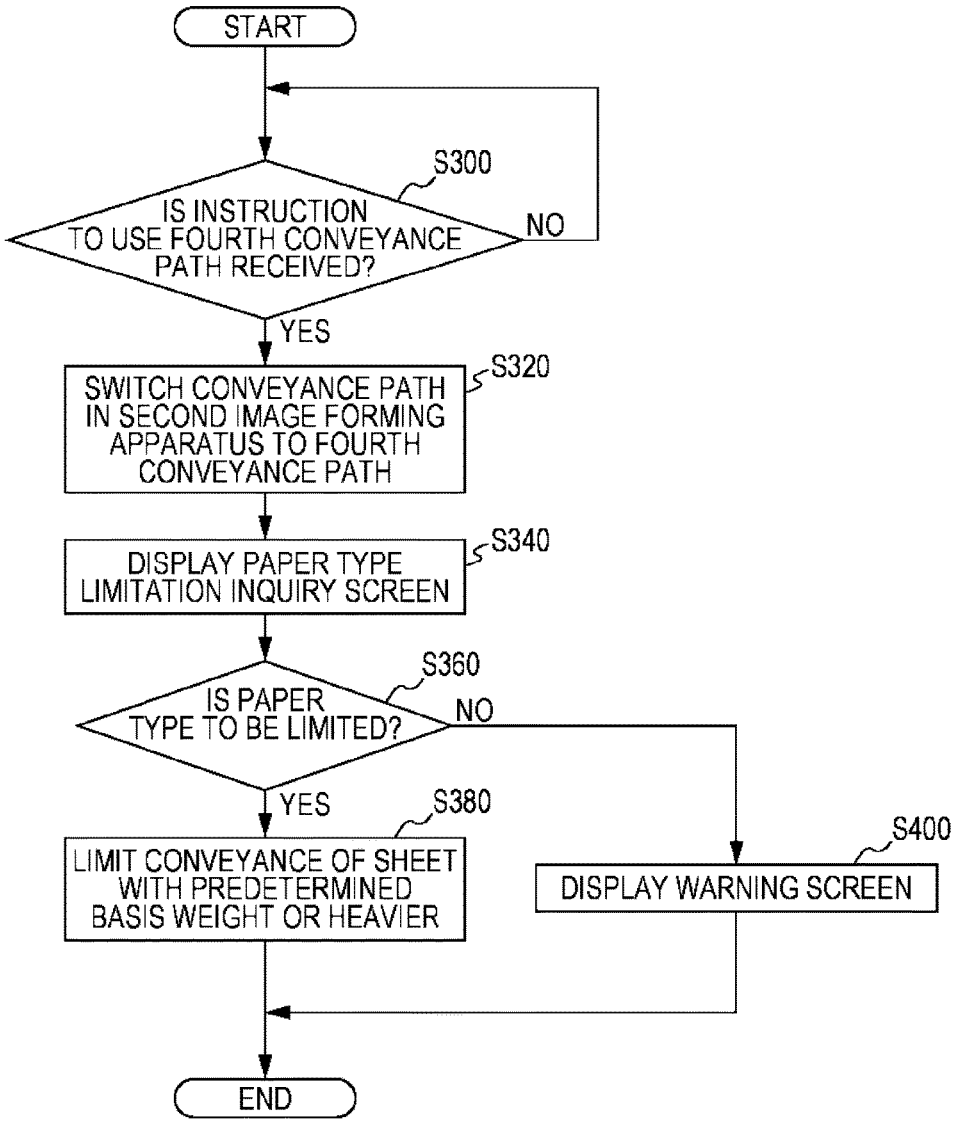
FIG. 5 is a flowchart showing a sheet conveyance control process in the event of an image defect in an image formation process in the second image forming apparatus.

FIG. 5 is a flowchart showing a sheet conveyance control process in a case where an image defect is caused as a result of an image formation process in the second image forming apparatus 200. First, the control unit 205 determines whether or not an instruction requesting to convey a sheet by using the fourth conveyance path 202 is received from the user via the operation display unit 209 (S300). If it is determined that the instruction requesting to convey a sheet by using the fourth conveyance path 202 is not received (S300: NO), the process returns to before S300.

If the instruction requesting to convey a sheet by using the fourth conveyance path 202 is received (S300: YES), the control unit 205 outputs a request signal requesting to switch the conveyance path from the third conveyance path 201 to the fourth conveyance path 202 to the first conveyance control unit 111 of the first image forming apparatus 100 via the communication unit 206. The first conveyance control unit 111 receives the request signal output from the control unit 205, and performs control to switch the switching gate 212 to switch the conveyance path in the second image forming apparatus 200 from the third conveyance path 201 to the fourth conveyance path 202 (S320). Since the processing in S340 to S400 subsequent to S320 is similar to that in S160 to S220 explained in FIG. 4, the explanation thereof will not be repeated.

While operations in the case where a user finds occurrence of an image defect and the conveyance path is switched in accordance with the user's instruction has been explained in FIG. 5, the conveyance path may alternatively be switched in accordance with a user's instruction when a paper jam occurs.

Furthermore, in the embodiment, the first image forming apparatus 100 may have the second conveyance control unit 211 while the second image forming apparatus 200 may have the first conveyance control unit 111. In other words, when a problem in image formation occurs in one of the first and second image forming apparatuses 100 and 200, the image forming apparatus in which the problem is present may perform conveyance control for conveying a sheet by using the bypass path by itself.

Furthermore, although an example in which the second conveyance path 102 and the fourth conveyance path 202, which are bypass paths, are also used as two-side conveyance paths has been explained in the embodiment, the present invention is not limited thereto. The bypass paths may be provided separately from the two-side conveyance paths. As a result of providing bypass paths separately from the two-side conveyance paths, the conveyance direction of the two-side conveyance paths need not be switched between a case where two-sided printing is to be performed on a sheet and a case where a sheet is only conveyed without image formation being performed thereon, which simplifies the conveyance control of a sheet on the two-side conveyance path.

Furthermore, although an example in which the second conveyance path 102 and the fourth conveyance path 202, which are bypass paths, are provided below the first conveyance path 101 and the third conveyance path 201, respectively, has been explained in the embodiment, the second conveyance path 102 and the fourth conveyance path 202 may be provided above the first conveyance path 101 and the third conveyance path 201.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A series-connected tandem image forming system comprising first and second image forming apparatuses capable of forming images on recording media by image forming units, the first and second image forming apparatuses being connected in series, the image forming system forming an image on a recording medium by either one or both of the first and second image forming apparatuses, wherein the first image forming apparatus includes a first conveyance path for conveyance of the recording medium and a second conveyance path for conveyance of the recording medium, the first conveyance path provided with an image forming unit, the second conveyance path provided with no image forming unit and configured to bypass the image forming unit of the first conveyance path such that the recording medium conveyed from a feeding unit storing recording media therein is conveyed to the second image forming apparatus by the second conveyance path, the first and second conveyance paths being selectable therebetween, the second image forming apparatus includes a third conveyance path for conveyance of the recording medium and a fourth conveyance path for conveyance of the recording medium, the third conveyance path being provided with an image forming unit, the fourth conveyance path provided with no image forming unit and configured to bypass the image forming unit of the third conveyance path such that the recording medium conveyed from the first image forming apparatus is discharged from the second image forming apparatus by the fourth conveyance path, the third and fourth conveyance paths being selectable therebetween, and the first conveyance path and the third conveyance path convey the recording medium linearly, and the second conveyance path and the fourth conveyance path are conveyance paths that include curves through which the recording medium is conveyed, wherein the image forming system further comprises a first conveyance control unit configured to perform a conveyance control of the second image forming apparatus and a second conveyance control unit configured to perform a conveyance control of the first image forming apparatus, at least one of the first conveyance control unit and the conveyance second control unit is configured to convey recording media having a predetermined basis weight through the first conveyance path and the third conveyance path.

2. The image forming system according to claim 1, wherein the first conveyance control unit is configured to perform first conveyance control for conveying a recording medium supplied from the first image forming apparatus to the second image forming apparatus by using the fourth conveyance path when a problem in image formation has occurred in the second image forming apparatus; and the second conveyance control unit is configured to perform second conveyance control for conveying a recording medium by using the second conveyance path when a problem in image formation has occurred in the first image forming apparatus.

3. The image forming system according to claim 2, wherein the first conveyance control unit performs the first conveyance control in response to a user's operation, and the second conveyance control unit performs the second conveyance control in response to a user's operation.

4. The image forming system according to claim 2, wherein the first image forming apparatus includes the first conveyance control unit, and the second image forming apparatus includes the second conveyance control unit.

5. The image forming system according to claim 1, wherein for forming images on both faces of a recording medium in the first image forming apparatus, the second conveyance path is used as a two-side conveyance path for conveying a recording medium having an image formed on one face thereof while being conveyed on the first conveyance path to the first conveyance path again, and for forming images on both faces of a recording medium in the second image forming apparatus, the fourth conveyance path is used as a two-side conveyance path for conveying a recording medium having an image formed on one face thereof while being conveyed on the third conveyance path to the third conveyance path again.

6. The image forming system according to claim 1, wherein the first image forming apparatus has a two-side conveyance path, for conveying a recording medium having an image formed on one face thereof while being conveyed on the first conveyance path to the first conveyance path again, separately from the second conveyance path, and the second image forming apparatus has a two-side conveyance path, for conveying a recording medium having an image formed on one face thereof while being conveyed on the third conveyance path to the third conveyance path again, separately from the fourth conveyance path.

7. The image forming system according to claim 1, further comprising:

a first informing unit configured to inform that the second conveyance path is available while a problem in image formation has occurred in the first image forming apparatus; and a second informing unit configured to inform that the fourth conveyance path is available while a problem in image formation has occurred in the second image forming apparatus.

8. A series-connected tandem image forming system comprising first and second image forming apparatuses capable of forming images on recording media by image forming units, the first and second image forming apparatuses being connected in series, the image forming system forming an image on a recording medium by either one or both of the first and second image forming apparatuses, wherein the first image forming apparatus includes a first conveyance path for conveyance of the recording medium and a second conveyance path for conveyance of the recording medium, the first conveyance path provided with an image forming unit, the second conveyance path provided with no image forming unit and configured to bypass the image forming unit of the first conveyance path such that the recording medium conveyed from a feeding unit storing recording media therein is conveyed to the second image forming apparatus by the second conveyance path, the first and second conveyance paths being selectable therebetween, the second image forming apparatus includes a third conveyance path for conveyance of the recording medium and a fourth conveyance path for conveyance of the recording medium, the third conveyance path being provided with an image forming unit, the fourth conveyance path provided with no image forming unit and configured to bypass the image forming unit of the third conveyance path such that the recording medium conveyed from the first image forming apparatus is discharged from the second image forming apparatus by the fourth conveyance path, the third and fourth conveyance paths being selectable therebetween, and the series-connected tandem image forming system further comprises:

a first informing unit configured to inform that the second conveyance path is available while a problem in image formation has occurred in the first image forming apparatus; and a second informing unit configured to inform that the fourth conveyance path is available while a problem in image formation has occurred in the second image forming apparatus.

9. The image forming system according to claim 8, further comprising:

a first conveyance control unit configured to perform first conveyance control for conveying a recording medium supplied from the first image forming apparatus to the second image forming apparatus by using the fourth conveyance path when a problem in image formation has occurred in the second image forming apparatus; and a second conveyance control unit configured to perform second conveyance control for conveying a recording medium by using the second conveyance path when a problem in image formation has occurred in the first image forming apparatus.

10. The image forming system according to claim 9, wherein the first conveyance control unit performs the first conveyance control in response to a user's operation, and the second conveyance control unit performs the second conveyance control in response to a user's operation.

11. The image forming system according to claim 9, wherein the first image forming apparatus includes the first conveyance control unit, and the second image forming apparatus includes the second conveyance control unit.

12. The image forming system according to claim 8, wherein for forming images on both faces of a recording medium in the first image forming apparatus, the second conveyance path is used as a two-side conveyance path for conveying a recording medium having an image formed on one face thereof while being conveyed on the first conveyance path to the first conveyance path again, and for forming images on both faces of a recording medium in the second image forming apparatus, the fourth conveyance path is used as a two-side conveyance path for conveying a recording medium having an image formed on one face thereof while being conveyed on the third conveyance path to the third conveyance path again.

13. The image forming system according to claim 8, wherein the first image forming apparatus has a two-side conveyance path, for conveying a recording medium having an image formed on one face thereof while being conveyed on the first conveyance path to the first conveyance path again, separately from the second conveyance path, and the second image forming apparatus has a two-side conveyance path, for conveying a recording medium having an image formed on one face thereof while being conveyed on the third conveyance path to the third conveyance path again, separately from the fourth conveyance path.

14. The image forming system according to claim 8, wherein the first conveyance path and the third conveyance path convey the recording medium linearly, and the second conveyance path and the fourth conveyance path are conveyance paths that include curves through which the recording medium is conveyed.

* * * * *